United States Patent [19]

Grush

[11] 4,385,780

[45] May 31, 1983

[54] CYLINDRICAL HOIST BUCKET FOR FREE FLOWING GRANULAR MATERIAL

[76] Inventor: Robert J. Grush, P.O. Box 7528, Metairie, La. 70002

[21] Appl. No.: 227,436

[22] Filed: Jan. 22, 1981

[51] Int. Cl.[3] ..... B66C 3/00

[52] U.S. Cl. ..... 294/70; 414/624

[58] Field of Search ..... 294/70, 107, 108, 109, 294/111, 112; 37/182, 183, 184, 185, 186, 187, 188; 254/188, 189; 414/694, 726, 624

[56] References Cited

U.S. PATENT DOCUMENTS

| | | | |
|---|---|---|---|
| 424,571 | 4/1890 | Pay | 294/70 |
| 512,828 | 1/1894 | Hunt | 294/70 |
| 2,889,643 | 6/1959 | Chatrenet | 37/183 |
| 3,187,916 | 6/1965 | O'Leary | 214/657 |
| 3,194,329 | 7/1965 | Wallers | 175/316 |
| 3,589,766 | 6/1971 | Barmilioli | 294/106 |
| 3,606,435 | 9/1971 | Weber | 294/70 |
| 3,627,371 | 12/1971 | Billings | 294/171 |
| 3,807,589 | 4/1974 | Shovick | 214/147 R |
| 3,896,950 | 7/1975 | McCain | 214/138 R |
| 4,005,895 | 2/1977 | Cullings | 294/65.5 |
| 4,059,886 | 11/1977 | Luc Bricon | 29/426 |

*Primary Examiner*—James B. Marbert

*Attorney, Agent, or Firm*—James B. Lake, Jr.

[57] ABSTRACT

Two nested half cylinders, having a concentric axis and closed ends, are pivoted together on aligned pivot pins mounted in the closed ends and on the concentric axis. The nested half cylinders are actuated to pivot 90 degrees oppositely around the concentric axis and aligned pivot pins to close non-compressively around free flowing granular material in a closed cylindrical hoist bucket, thereby saving the additional weight and strength of material and the actuating energy therefor required for compressive loading of hoist buckets having off center or non-concentric axis of pivot. Additionally, the non-compressive loading does not move the granular material nor overflow the closed cylindrical hoist bucket to pollute the environment with dust therefrom.

2 Claims, 4 Drawing Figures

CYLINDRICAL HOIST BUCKET FOR FREE FLOWING GRANULAR MATERIAL

BACKGROUND OF THE INVENTION

The invention relates generally to hoist buckets, and more particularly to cylindrical hoist bukets for moving free flowing granular material with cranes and traveling gantries.

Hereto the prior art has taught clamshell hoist buckets comprising two or more scoop elements pivoted together on non-concentric scoop centers that compress scooped material. See U.S. Pat. Nos. to Bricon 4,059,886; Cullings 4,005,895; McCain 3,627,371; Bormiola 3,589,766; Wallers 3,194,329; Chatrenet 2,889,643; Billings 3,627,371; O'Leary 3,187,916; and Shovick 3,807,589. The closest reference is Weber, U.S. Pat. No. 3,606,435 which teaches a bore hole clamshell hoist bucket comprising two quarter spherical scoop elements pivoted concentrically to form an open half spherical bucket.

The invention teaches a cylindrical hoist bucket comprising two nested half cylinders pivoted together at respective closed ends on a common concentric axis for each half cylinder to pivot 90 degrees to completely close around free flowing granular material without compressing said material and allowing escape of dust from said material.

SUMMARY OF THE INVENTION

The cylindrical hoist bucket of the invention, because of concentric pivoting of nested half cylinder scoop elements, requires less force to close around said material, and thus requires less structure strength and weight because the scooped material is not compressed as in conventional clamshell hoist buckets and being closed can move dusty material without polluting the environment. The lighter hoist bucket requires less operating time to open and close and has a reduced weight-of-bucket to volume-of-material ratio.

An object of the invention is to provide a lighter and cheaper hoist bucket with no reduction in performance.

Another object of the invention is to provide a hoist bucket requiring less energy to operate with no diminution in performance.

Still another object of the invention is to provide a hoist bucket that does not contribute to dust pollution of the environment.

DETAILED DESCRIPTION OF THE PREFERRED EMBODIMENT

Figure 1:
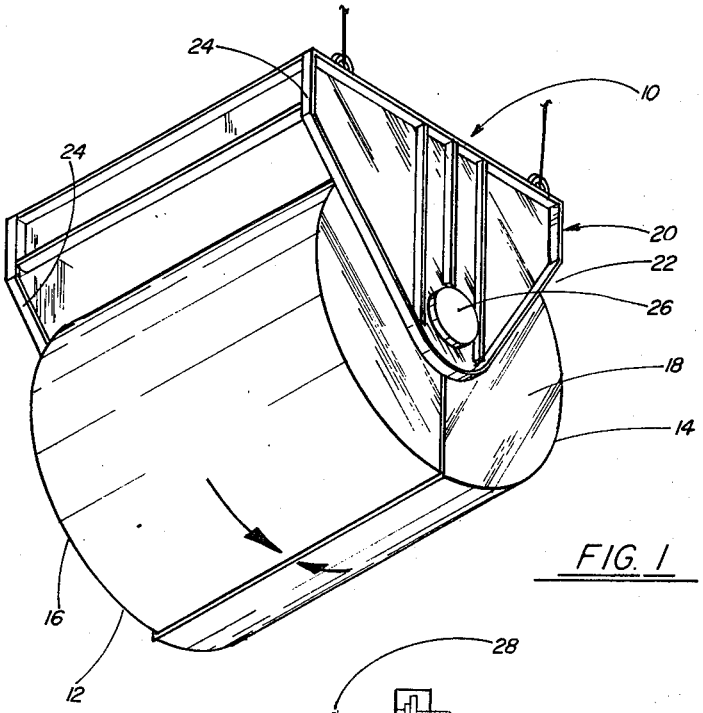
FIG. 1 is a three dimensional view of the cylindrical hoist bucket of the invention.
Figure 3:
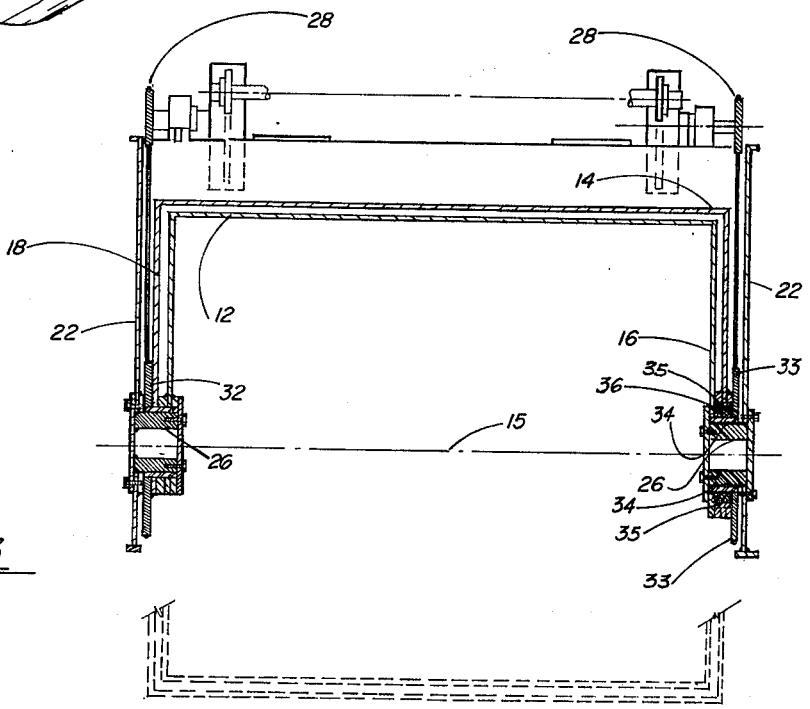
FIG. 3 is a sectional view taken along section lines 3—3 of FIG. 2.
Figure 4:
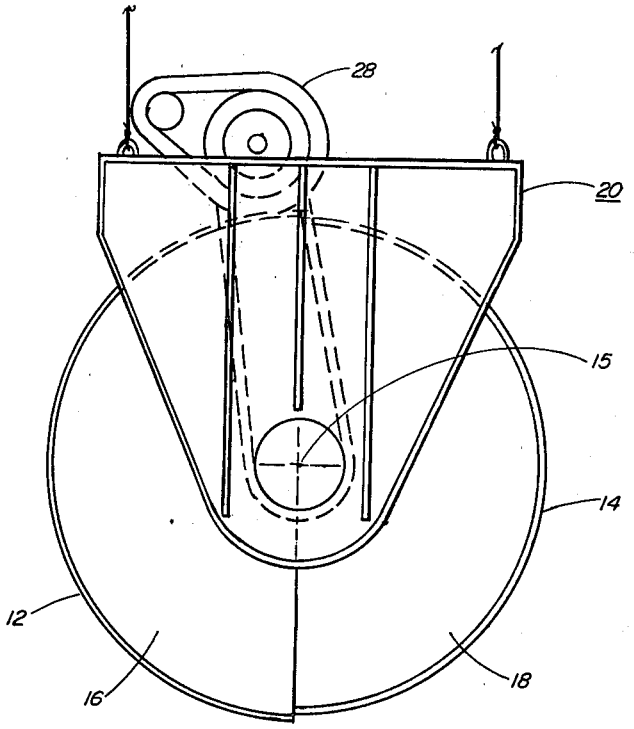
FIG. 4 is an end view of the invention in closed position.
Figure 2:
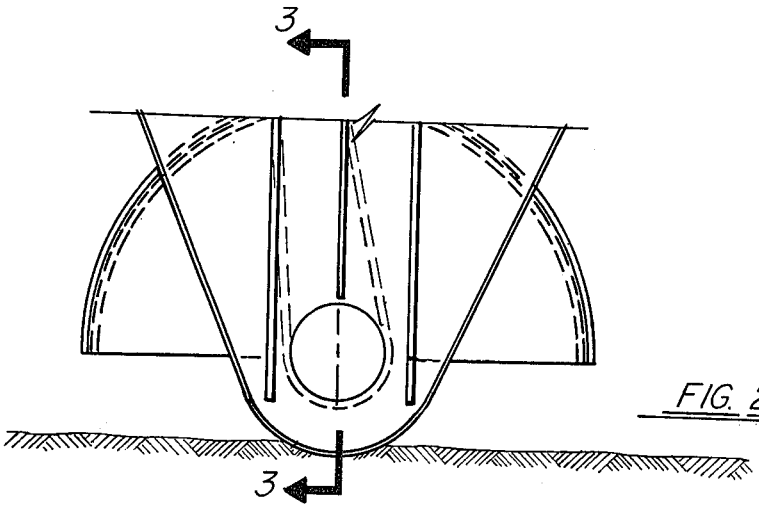
FIG. 2 is an end view of the invention in an open or nesting position.

Referring to FIGS. 1–4, the hoist bucket 10 of the invention comprises nested inner and outer half cylinders 12 and 14 respectively, having a common concentric axis 15 and closed ends 16 and 18. A suspensive structure 20 comprises a flat frame 21 with depending ends 22 normal thereto, each said depending end converging to a rounded lower extremity defining holes respective aligned and on said common concentric axis 15 and spaced apart for said half cylinders to be pivotally mounted as hereinafter explained on pivot pins 26 fixed in said holes. Similar drive sheaves 28, and sheave driving apparatus 29 are mounted for rotation on flat frame 21 respectively inboard of each of said depending ends 22. Drive wires 30 engage drive sheaves 28 with respective driven left and right sheaves 32 and 34 that are bushed on respective pivot pins 26 below and vertically aligned with sheaves 28. Left sheave 32 is fixed outboard of and to outer half cylinder end 18 for pivoting with sheave 32. Right sheave 34 is fixed outboard of outer half cylinder end 18 and to inner half cylinder end 16 by an inwardly projecting hub 36. Inner cylinder left end 16 is bushed on left pivot pin 26, and outer half cylinder right end 18 is bushed on hub 36. Thus, both inner and outer half cylinders are pivotable 90 degrees by respective driven sheaves 32 and 33 to open and close.

In operation, hoist bucket 10 is attached to any convenient hoisting device such as a crane or traveling gantry (not shown), and the drive apparatus 29 mounted on suspending structure flat frame 21 connected to an auxiliary power source (not shown) of said crane for driving sheaves 28, 32 and 33 to rotate half cylinders 12 and 14 to open and close bucket 10. With the half cylinders nested, the bucket is lowered gently on a pile of free flowing granular material and the half cylinders rotated to close the bucket to enclose a full bucket of granular material without overflow and without the necessity of dropping the bucket from a great height and stirring up a cloud of dust. The bucket is always closed at the top to prevent dust from escaping during the opening and closing thereof. The rotation of the half cylinders around a concentric axis merely encloses granular material and does not move it to stir up dust, overflow the bucket, and compress the bucket contents.

I claim:

1. A cylindrical hoist bucket, for use with cranes and traveling gantries to move free-flowing granular material, comprises:

(a) suspensive structure means having a flat upper frame for attaching to cranes and gantries, and having opposing ends depending from said flat frame and tapering to define aligned holes in the respective lower extremities of said opposing ends;

(b) respective pivot pins fixed in each of said aligned holes defined in said depending ends;

(c) a pair of nested inner and outer half cylinders, having closed ends and a common concentric axis passing thru said closed ends, said closed ends being connected by and mounted in said suspensive structure on said pivot pins, and said half cylinders being adapted for each to pivot 90 degrees around said concentric axis and said pivot pins to form a closed cylindrical hoist bucket, and to pivot oppositely 90 degrees back to an open cylindrical hoist bucket;

(d) driven sheaves respectively fixed to an opposite closed end of each of said half cylinders, said sheaves being adapted to pivot with the associated half cylinder; and (e) drive sheaves and driving means mounted on said flat frame and adapted to respectively pivot said driven sheaves and associated half cylinders fixed thereto.

2. A cylinder hoist bucket as described in claim 1, wherein said driven sheaves comprise:

(a) a left driven sheave fixed to said left closed end of said outer half cylinder and bushed together with said left closed end of said inner half cylinder on said left pivot pin; and (b) a right driven sheave having an inwardly projecting hub fixed to said right closed end of said inner half cylinder, said hub and sheave being bushed together on said right pivot pin, and with said right closed end of said outer half cylinder being bushed on said inwardly projecting hub.

* * * * *